US006511163B1

(12) United States Patent
Pinard

(10) Patent No.: US 6,511,163 B1
(45) Date of Patent: Jan. 28, 2003

(54) PRINTING SYSTEM

(75) Inventor: Adam I. Pinard, Carlisle, MA (US)

(73) Assignee: Iris Graphics, Inc., Billerica, MA (US)

( * ) Notice: Subject to any disclaimer, the term of this patent is extended or adjusted under 35 U.S.C. 154(b) by 0 days.

(21) Appl. No.: 09/041,211

(22) Filed: Mar. 12, 1998

(51) Int. Cl.[7] ..... B41J 2/075
(52) U.S. Cl. ..... 347/74; 347/78; 347/79
(58) Field of Search ..... 347/74, 43, 75, 347/73, 41, 78, 79

(56) References Cited

U.S. PATENT DOCUMENTS

| | | | | | |
|---|---|---|---|---|---|
| 3,298,030 | A | | 1/1967 | Lewis et al. | 346/75 |
| 3,373,437 | A | | 3/1968 | Sweet et al. | 346/75 |
| 3,562,757 | A | | 2/1971 | Bischoff | 346/1 |
| 3,596,275 | A | | 7/1971 | Sweet | 346/75 |
| 3,723,646 | A | * | 3/1973 | Behane et al. | 347/74 X |
| 3,827,057 | A | | 7/1974 | Bischoff et al. | 346/75 |
| 3,828,354 | A | | 8/1974 | Hilton | 346/1 |
| 3,895,386 | A | | 7/1975 | Keur et al. | 346/1 |
| 3,928,718 | A | | 12/1975 | Sagae et al. | 346/75 |
| 3,972,052 | A | | 7/1976 | Atumi et al. | |
| 3,977,007 | A | * | 8/1976 | Berry et al. | 347/15 |
| 4,051,485 | A | | 9/1977 | Yamada | 346/75 |
| 4,065,773 | A | | 12/1977 | Berry | 346/75 |
| 4,069,485 | A | | 1/1978 | Martin | 346/75 |
| 4,085,409 | A | | 4/1978 | Paranipe | 346/75 |
| 4,314,258 | A | | 2/1982 | Donahue et al. | 346/75 |
| 4,321,607 | A | | 3/1982 | Heibein et al. | 346/75 |
| 4,364,057 | A | | 12/1982 | Ebi et al. | 346/75 |
| 4,384,295 | A | | 5/1983 | Lewis et al. | 346/75 |
| 4,424,518 | A | | 1/1984 | Suzuki et al. | 346/75 |
| 4,467,366 | A | * | 8/1984 | Bobick et al. | 347/3 X |
| 4,525,721 | A | | 6/1985 | Crean | 346/1.1 |
| 4,562,442 | A | | 12/1985 | Jinnai et al. | 346/75 |
| 4,598,299 | A | | 7/1986 | Koike et al. | 346/75 |
| 4,620,198 | A | * | 10/1986 | Behun | 346/75 |
| 4,667,830 | A | | 5/1987 | Nozaki, Jr. et al. | 209/3.1 |
| 4,942,462 | A | | 7/1990 | Shiota | 358/76 |
| 5,182,803 | A | | 1/1993 | Rodi et al. | 395/575 |
| 5,700,692 | A | | 12/1997 | Sweet | 436/50 |
| 5,946,454 | A | * | 8/1999 | Shu et al. | 395/109 |

FOREIGN PATENT DOCUMENTS

| | | | | |
|---|---|---|---|---|
| JP | 60-52356 A | * | 3/1985 | 347/74 |

OTHER PUBLICATIONS

Ghouse, "Simulation of a Nonlinear Fluid System Servo for Drop Flightime Control in an Ink–Jet Printer," Proceedings of the 1978 Summer Computer Simulation Conference abstract 1978.

Heinzl and Hertz, "Ink–Jet Printing," Advances in Electronics and Electron Physics, vol. 65, pp. 91–171, 1985.

IBM Journal of Research and Development, vol. 21, No., pp. 1–96, Jan. 1997.

Samuelson, "Ink Jet Printing of color Images. Dither Matrix and Halftone Methods," Department of Electrical Measurements, Lund Institute of Technology, pp. 58–59, Aug. 1985.

* cited by examiner

*Primary Examiner*—Huan Tran
(74) *Attorney, Agent, or Firm*—Kristofer E. Elbing

(57) ABSTRACT

A method of jet printing is disclosed in which a jet printing fluid source advances in a helical progression with respect to a drum, and drops from the jet printing fluid source are guided to a substrate in steps that define a swathing order that separates their trajectories. A printing system is also disclosed in which a digital filtering function is applied to a desired input position value to obtain a guiding value for a drop of printing fluid.

32 Claims, 2 Drawing Sheets

PRINTING SYSTEM

FIELD OF THE INVENTION

This invention relates to jet printers, including jet printers for direct-to-plate printing systems.

BACKGROUND OF THE INVENTION

Ink-jet printers operate by charging drops of ink with a charging electrode and guiding them to a print substrate through a high intensity electric field. Printers can modulate the charge on an ink drop by changing the charging electrode voltage to select whether each drop is to be printed or instead sent to a gutter. Printers may also adjust the charging voltage to compensate for aerodynamic effects and for the influence of the charge from adjacent drops. Some printers employ a technique known as "swathing" to continuously change the field and thereby direct drops from one or more stationary ink jets to different locations on the printing substrate, instead of moving a print head across the substrate.

Jet printing techniques are applicable to direct-to-plate printers. Such printers typically apply a printing fluid to a sheet of plate stock mounted on a drum. This fluid causes changes in the portions of the surface of the plate on which it is deposited. Although further processing of the plate may be necessary, the result is a printing plate that can serve to print large numbers of pages.

SUMMARY OF THE INVENTION

In one general aspect, the invention features a jet printer that includes a jet printing fluid source, at least one deflection element located proximate an output trajectory of the fluid source, a digital filter, and a digital-to-analog converter operatively connected between an output of the filter and at least the deflection element.

The printer can further include a processor portion operative to drive the printer to print half-tone images on a print substrate, which can be a printing plate. The printer can further include a drum having a print substrate mounted on the drum, and a carriage mechanism for moving the jet printing fluid source and the deflection element perpendicular to a feed direction of a print substrate, which can be a printing plate. The printer can further include a swathing table, and a control circuit responsive to the swathing table and having an output operatively connected to the digital filter. The digital filter can be constructed and adapted to operate on a desired position for a printing fluid drop, on previous desired positions for printing fluid drops from the jet printing fluid source, and on previous outputs of the filter. The digital filter is an IIR filter. The digital filter can have a transfer function that includes a sum of previous input position values each multiplied by one of a first plurality of coefficients, and previous output deflection values each multiplied by one of a second plurality of coefficients.

In another general aspect, the invention features a jet printer that includes a drum having a print substrate mounted on it, a movable carriage, and a jet printing fluid source attached to the carriage. At least one deflection element is located proximate an output trajectory of the jet printing fluid source, and a carriage mechanism is provided for moving the carriage along a direction of an axis of rotation of the drum. The printer also includes a swathing table, and a control circuit responsive to the swathing table and having an output provided to at least the one deflection element.

The deflection element can be a charging tunnel surrounding an output of the jet printing fluid source or one of a pair of deflection electrodes. The jet printer can further include a processor portion operative to drive the printer to print half-tone images on a print substrate. A print substrate placed in the output trajectory of the jet printing fluid source can be a printing plate. A drum actuation controller can be provided which is synchronized with the control circuit to cause printing by the printer to take place according to a helical progression.

In a further general aspect, the invention features a method of jet printing, that includes electromagnetically guiding charged drops of printing fluid to a print substrate through a electromagnetic field, applying a digital filtering function to a desired input position value, to obtain a guiding value for a further drop of printing fluid, and electromagnetically guiding the further charged drop of printing fluid to the substrate.

The step of applying can apply a transfer function that includes a sum of previous input position values each multiplied by one of a first plurality of coefficients, and previous guiding values each multiplied by one of a second plurality of coefficients.

In another general aspect, the invention features a method of jet printing that includes moving a jet printing fluid source to a first position along a direction of an axis of rotation of a print substrate, electromagnetically guiding a first drop of printing fluid from the jet printing fluid source at the first position so that it lands on the print substrate at a first distance along the direction of the axis of rotation of the print substrate, rotating the print substrate relative to the jet printing fluid source about the axis of rotation after the step of electromagnetically guiding a first drop, and electromagnetically guiding a second drop of printing fluid from the jet printing fluid source at the first position so that it lands on the print substrate at a second distance along the direction of the axis of rotation of the print substrate after the print substrate has rotated, wherein the second distance is different from the first distance.

The method can further include electromagnetically guiding further drops of printing fluid from the jet printing fluid source at the first position so that the further drops land on the print substrate at further different distances along the direction of the axis of rotation of the print substrate, after the print substrate has rotated further. The steps of guiding and rotating can form a part of a half-tone printing process.

In a further general aspect, the invention features a jet printer that includes means for electromagnetically guiding each of a plurality of charged drops of printing fluid to a print substrate through an electromagnetic field, means for applying a digital filtering function to a desired input position value and to values of charge on the drops relative to the electromagnetic field, to obtain a deflection value for a further drop of printing fluid, and means for converting the deflection value to an electromagnetic field intensity to guide the further drop to the substrate.

The means for of applying a digital filtering function can apply a transfer function that includes a sum of previous input position values each multiplied by one of a first plurality of coefficients, and previous deflection values each multiplied by one of a second plurality of coefficients.

In another general aspect, the invention features a jet printer that includes means for moving a jet printing fluid source to a first position along a direction of an axis of rotation of a print substrate, means for rotating the print substrate relative to the jet printing fluid source about the axis of rotation, and means for electromagnetically guiding a first drop of printing fluid from the jet printing fluid source at a first position so that it lands on the print substrate at a first distance along the direction of the axis of rotation of the print substrate, for electromagnetically guiding a second drop of printing fluid from the jet printing fluid source at the first position so that it lands on the print substrate at a second distance along the direction of the axis of rotation of the print substrate after the print substrate has rotated, wherein the second distance is different from the first distance.

The means for electromagnetically guiding can further be for guiding the first and second drops at locations that are spaced apart both longitudinally and radially with respect to the axis of rotation. The printer can further include means for causing the means for guiding to perform a half-tone printing process.

Systems according to the invention can be advantageous in that they provide an inexpensive, accurate and flexible method of controlling the trajectory of drops of printing fluid in jet printing. By treating drops as samples in a sampled-data system, printers can perform swathing, aerodynamic compensation, and adjacent drop compensation in the digital domain using an existing printer control processor or an inexpensive add-on microprocessor. Such printers can also be reconfigured for different printing applications without requiring a redesigned analog circuit, and they may even be digitally calibrated at start-up or on-the-fly to improve print characteristics. These features can improve the quality of printing, and can reduce the cost and time involved in developing improved printers.

Systems according to the invention may also permit printing operations to take place more quickly and efficiently, in moving-head, direct-to-plate, jet printers. Swathing can permit such printers to deposit individual charged drops that are spaced apart in two polar dimensions on a plate as it rotates. This allows for fine-pitch printing at high speeds with a minimum number of guard drops.

DETAILED DESCRIPTION OF AN ILLUSTRATIVE EMBODIMENT

Figure 1:
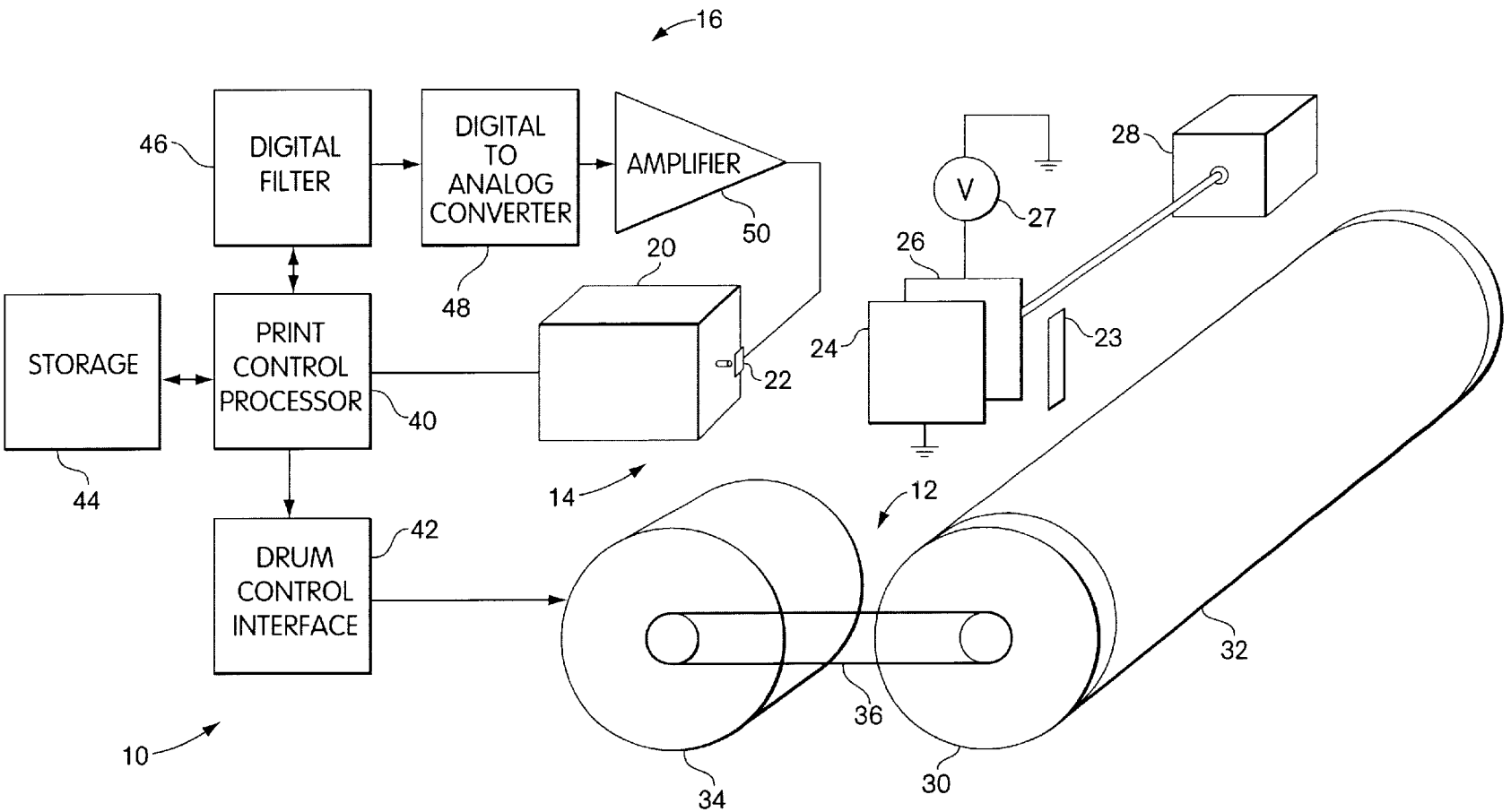
FIG. 1 is a system-level block diagram illustrating elements of a jet printer according to the invention.

A jet printer 10 according to the invention includes a print substrate feed mechanism 12, a print head assembly 14, and a control circuit 16. The feed mechanism includes a print drum 30, which supports a print substrate 32, such as a piece of paper print stock or a printing plate. A motor 34 drives the drum 30 via a coupling mechanism 36.

The print head assembly 14 includes a print head that includes a nozzle assembly 20 having a charging electrode 22, such as a charging tunnel, at its output, with a pair of deflection electrodes 24, 26 located on opposite sides of the path that a drop takes when exiting the nozzle. The deflection electrodes, the charging tunnel, and the nozzle assembly are all mounted on a carriage driven by a carriage actuator 28. The carriage actuator is operative to move the carriage along a path that is parallel to the axis of rotation of the drum.

The control circuit 16 includes a print control processor 40 having a control output provided to a drum control interface 42. The print control processor also has a data port operatively connected to a data port of a storage element 44, and a data port operatively connected to a digital filter 46. The digital filter has an output provided to a digital input of a digital-to-analog converter 48, which has an analog output provided to an input of a high-voltage amplifier 50. The amplifier has an output that is operatively connected to the charging electrode 22. Also provided is a high-voltage source 27 that can be controlled by the print control processor 40 and that has an output operatively connected to one of the deflection electrodes 26. The other deflection electrode 24 can be operatively connected to a fixed voltage source, such as ground.

FIG. 1 is intended as a general illustration of a printer according to the invention, and one of skill in the art would be able to modify its design in a number of ways while still obtaining benefits from the invention for different applications. For example, a number of different mechanisms can be used for the carriage actuator such as toothed-belt or lead-screw mechanisms. And while a drum-based feed mechanism 12 is appropriate for printing directly on lithographic plates, other printing applications may employ different kinds of mechanisms, such as continuous feed paper on a platten.

Features and functionality of the various circuit elements shown in FIG. 1 can also be combined in different ways. For example, the print control processor 40 can incorporate control routines that control the motor 34, allowing a signal from the print control processor or a simple buffered version of that signal to drive the motor. This eliminates the need for a dedicated hardware drum control circuit 42, which receives only a simple on/off signal from the print control processor. The print control processor can be located inside the printer, or it can be located remote from the printer and communicate with the printer, such as via serial cable.

Note that it is also possible to apply the invention to different types of deflection configurations by modulating the excitation provided to one or more of its deflection elements. For example, it is possible to modulate the voltage on the deflection electrodes 24, 26 instead of, or in addition to, modulating the voltage on the charging electrode 22. In addition, it is also possible to operate a jet printer without a charging electrode and modulate only a voltage on one or more deflection electrodes. It is also possible to modulate other approaches to guiding a drop, such as by modulating a magnetic field instead of an electric field.

Figure 2:
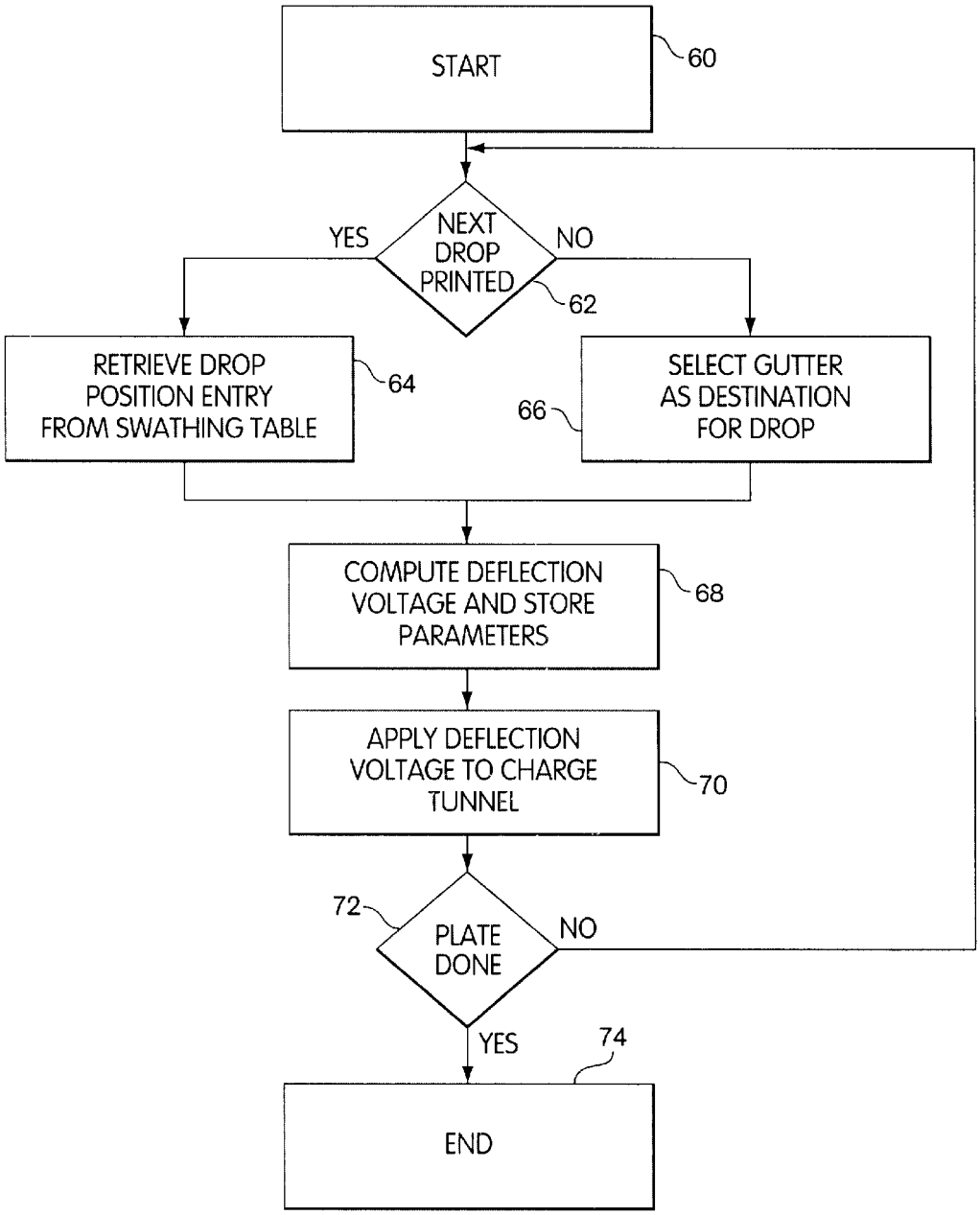
FIG. 2 is a flow chart illustrating the operation of the printer of FIG. 1.

In operation, referring to FIGS. 1 and 2, operation of the jet printer 10 begins with operator set-up of the printer and a software start command (step 60). In the case of a direct-to-plate printer that prints on aluminum or plastic plates, an operator first mounts a fresh plate 32 on the printer's drum 30. The operator then causes a host system to download data representing the material to be printed into the print control processor 40. The print control processor can also download coefficients into the digital filter 46, or run a calibration routine to derive these coefficients, if these are not stored locally. Calibration can be performed by depositing printing fluid drops on a calibration needle and adjusting the filter coefficients until an optimal transfer function has been reached. The processor can then instruct the drum control interface 42 to start the motor 34, which causes the drum 30 to rotate.

After the drum is up to speed, the print control processor 40 instructs the nozzle assembly 20 to generate a series of charged printing fluid drops, which pass through the charging electrode 22 and then between the deflection electrodes 24, 26. The magnitude of the voltage to be applied to the charging electrode 22 by the amplifier 50 depends on whether and where each particular drop is to be printed (step 62). If a drop is not to be printed, such as in the case of a guard drop, the print control processor 40 will select a gutter or knife edge 23 as the destination for the drop (step 66). The print control processor will then compute an appropriate voltage to be applied to the charging electrode given the voltage between the deflection electrodes, to guide the drop into the gutter (step 68). Typically, this voltage is either the maximum or minimum voltage that the amplifier is configured to provide.

If the drop is to be printed, the print control processor 40 retrieves a drop position entry from a swathing table, which can be stored in the storage 44 (step 64). The entries in the swathing table are designed to cause successive, but non-adjacently deposited, drops to be separated from each other on the plate radially due to rotation of the drum and longitudinally due to the swathing. Because the drops are spaced in this way in these two polar dimensions, they will not touch each other. This is particularly important in half-tone printing, where only single, separate drops are deposited. Of course, the order in which the print data is sent to the print head must take the swathing sequence into consideration.

Superimposed on the swathing voltage is a voltage derived by the digital filter 46, which compensates for aerodynamic effects and for the influence of the charge on adjacent drops. The digital filter can be an Infinite-Impulse-Response (IIR) filter implemented using a digital signal processor, such as the TMS 320C203 integrated circuit available from Texas Instruments. The filter function implemented is:

$$\mathrm{OUT}(n)=B0*\mathrm{IN}(n)+B1*\mathrm{IN}(n-1)+B2*\mathrm{IN}(n-3)+A1*\mathrm{OUT}(n-1)+A2*\mathrm{OUT}(n-2)$$

Coefficients used in the function for one embodiment are:

TABLE 1

| IIR Coefficients | |
|---|---|
| b0 | 0.05 |
| b1 | 0.67 |
| b2 | −0.32 |
| a1 | 0.6 |
| a2 | 0 |

Where IN (n) represents the desired position of drop number n, and OUT(n) represents the electrode voltage for drop number n resulting from the application of the filter. In a system that has sufficient computational capacity, it is contemplated that further coefficients could be included in this function. Digital filter design is discussed in, for example, "Digital Signal Processing," Chapter 5, Alan VanOppenheim and Ronald W. Schafer, Prentice-Hall Inc. (1975), which is herein incorporated by reference.

Table 2 illustrates the operation of the digital filter for the initial drops to be printed in a print job. As can be seen from this table, charge interaction between drops and aerodynamic effects cause the filter voltage required to place the drop at a desired position to change from drop to drop.

TABLE 2

| Drop Number | Normalized Desired Drop Position | Normalized Charging Voltage |
|---|---|---|
| 0 | 1 | 0.050 |
| 1 | 1 | 0.750 |

TABLE 2-continued

| Drop Number | Normalized Desired Drop Position | Normalized Charging Voltage |
|---|---|---|
| 2 | 1 | 0.850 |
| 3 | 1 | 0.910 |
| 4 | 1 | 0.946 |
| 5 | 1 | 0.968 |
| 6 | I | 0.981 |
| 7 | 1 | 0.988 |
| 8 | 0 | 0.943 |
| 9 | 0 | 0.246 |
| 10 | 0 | 0.147 |
| 11 | 0 | 0.088 |
| 12 | 0 | 0.053 |
| 13 | 0 | 0.032 |
| 14 | 0 | 0.019 |
| 15 | 0 | 0.011 |
| 16 | 0 | 0.007 |

Once the charging voltage has been computed, the digital filter supplies a code corresponding to that voltage to the digital-to-analog converter 48. The digital-to-analog converter converts this code into an analog voltage, which it presents on its analog output. The amplifier 50 then amplifies the analog voltage to a high level, which is applied to the charging electrode 22 (step 70).

When a final drop has been sent (step 72), the printer can be powered down, or a new print operation can begin (step 74). If drops remain to be printed, the process of determining a charging electrode voltage begins again for the next drop (step 62).

In one particular embodiment, a printer employs a continuous jet head that has multiple jet assemblies and employs swathed bitmap capability to print up to 16 rasters per revolution per channel in a helical progression about the drum. This high resolution bitmap capability allows every drop to be used on halftone images without any of them merging.

It has been empirically determined that 1200 dots per inch (DPI) can be accomplished using a 10 um nozzle at jet velocity of 50 m/s printing a 16 pixel wide swath with a firing order of: 0, 8, 4, 12, 1, 9, 5, 13, 2, 10, 6, 14, 3, 11, 7, 15. This order is stored as a series of charge values in a 32-entry swathing table that also has an entry for non-printing drops, although other types of swathing tables can be used as well. The separation on the individual charges corresponds to a voltage of approximately 4 volts. This requires a total voltage swing of about 128 volts on the charging electrode. A nominal separation of 64 volts between printed and non-printed drops provides sufficient separation for the knife edge to operate properly.

The deflection voltage on the nozzle assemblies is programmable by software from 0 to 2200 Volts, and the deflection voltages for each nozzle assembly are to be sensed individually. Stimulation is common for all nozzle assemblies and is a square wave with an amplitude that can be controlled from 2.5 to 41 Volts. The charging voltage output has 1024 discrete levels between +35 and −115 Volts with a settling time of 125 ns.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. A jet printer, comprising:

a jet printing fluid source, at least one deflection element located proximate an output trajectory of the jet printing fluid source, a digital filter having inputs responsive to a desired drop position value, to one or more previous desired drop position values, and to one or more previous filter output deflection values, and a digital-to-analog converter operatively connected between an output of the digital filter and at least the deflection element.

2. The jet printer of claim 1, further including a processor portion operative to drive the printer to print half-tone images on a print substrate.

3. The jet printer of claim 1, further including a drum having a print substrate mounted on the drum, and a carriage mechanism for moving the jet printing fluid source and the deflection element perpendicular to a feed direction of a print substrate.

4. The jet printer of claim 1, further including a drum having a print substrate mounted on the drum, a carriage mechanism for moving the jet printing fluid source and the deflection element perpendicular to a feed direction of a print substrate, a swathing table, and a control circuit responsive to the swathing table and having an output operatively connected to the digital filter.

5. The jet printer of claim 4 wherein the print substrate is a printing plate.

6. The jet printer of claim 1 wherein the digital filter is an IIR filter.

7. The jet printer of claim 1 wherein the digital filter has a transfer function that includes a sum of:

previous input position values each multiplied by one of a first plurality of coefficients, and previous output deflection values each multiplied by one of a second plurality of coefficients.

8. A jet printer, comprising:

a drum constructed and adapted to receive a print substrate, a drum control interface having an output provided to a motor for rotating the drum, a movable carriage, a jet printing fluid source attached to the carriage, at least one deflection element located proximate an output trajectory of the jet printing fluid source, the deflection element having a deflection axis in the direction of an axis of rotation of the drum, a carriage mechanism for moving the carriage in the direction of the axis of rotation of the drum, such that the combined action of the carriage mechanism and drum control interface cause the jet printing fluid source to advance in a helical progression with respect to the drum during a plurality of drum rotations, a swathing table, and a control circuit responsive to the swathing table and having an output provided to at least the one deflection element.

9. The jet printer of claim 8 wherein the deflection element is a charging tunnel surrounding an output of the jet printing fluid source.

10. The jet printer of claim 8 wherein the deflection element is one of a pair of deflection electrodes.

11. The jet printer of claim 8 further including a processor portion operative to drive the printer to print half-tone images on a print substrate.

12. The jet printer of claim 8 wherein a print substrate placed in the output trajectory of the jet printing fluid source is a printing plate.

13. The jet printer of claim 8 wherein the swathing table includes a series of different firing order entries that define different deflection amounts for the deflection element, whereby the deflection element directs drops from the printing fluid source to a succession of different locations on the printing substrate.

14. The jet printer of claim 13 wherein the drop deflection values and the firing order entries represent voltages, and wherein the voltages are superimposed and provided to the deflection element via a digital-to-analog converter.

15. The jet printer of claim 8 wherein the swathing table is a stored swathing table.

16. The jet printer of claim 8 wherein the deflection element has a deflection axis whose sole component is in the direction of the axis of rotation of the drum, wherein the carriage mechanism and drum control interface are constructed and adapted to cause the jet printing fluid source to advance in a helix, and wherein the drum control interface is a drum control circuit that has an output line directly connected to the motor.

17. The jet printer of claim 8 wherein the jet printing fluid source is operative to deposit drops at a resolution of at least 1200 dots per inch.

18. The jet printer of claim 17 wherein the jet printing fluid source includes a nozzle.

19. The jet printer of claim 18 wherein the jet printing fluid source includes a 10 micrometer or smaller nozzle.

20. A method of jet printing, comprising:

electromagnetically guiding charged drops of printing fluid to a print substrate through an electromagnetic field, applying a digital filtering function to position values for the charged drops and a desired input position value, to obtain a guiding value for a further drop of printing fluid, wherein the step of applying applies a transfer function that includes a sum of at least one previous input position value for at least one of the charged drops multiplied by a first coefficient, and at least one previous guiding value for at least one of the charged drops multiplied by a second coefficient, and electromagnetically guiding the further charged drop of printing fluid to the substrate.

21. A method of jet printing, comprising:

electromagnetically guiding charged drops of printing fluid to a print substrate through an electromagnetic field, applying a digital filtering function to position values for the charged drops and a desired input position value, to obtain a guiding value for a further drop of printing fluid, wherein the step of applying applies a transfer function that includes a sum of previous input position values each multiplied by one of a first plurality of coefficients, and previous guiding values each multiplied by one of a second plurality of coefficients, and electromagnetically guiding the further charged drop of printing fluid to the substrate.

22. A method of jet printing, comprising the steps of:

moving a jet printing fluid source relative to a print substrate along the direction of an axis of rotation of a print substrate, electromagnetically guiding a first drop of printing fluid from the jet printing fluid source so that it lands on the print substrate at a first distance along the direction of the axis of rotation of the print substrate from the jet printing source, rotating the print substrate relative to the jet printing fluid source about the axis of rotation after the step of electromagnetically guiding a first drop, such that the combined action of the step of moving and the step of rotating cause the jet printing fluid source to advance in a helical progression with respect to the drum during a plurality of drum rotations, electromagnetically guiding a second drop of printing fluid from the jet printing fluid source so that it lands on the print substrate at a second distance along the direction of the axis of rotation of the print substrate from the jet printing source after the print substrate has rotated, wherein the second distance is different from the first distance, and wherein the steps of electromagnetically guiding define a swathing order for the first and second drops that separates trajectories of the first and second drops.

23. The jet printing method of claim 22 further including further steps of electromagnetically guiding further drops of printing fluid from the jet printing fluid source so that the further drops land on the print substrate at further different distances along the direction of the axis of rotation of the print substrate from the jet printing source, after the print substrate has rotated further.

24. The jet printing method of claim 22 wherein the steps of guiding and rotating form a part of a half-tone printing process.

25. The method of claim 22 wherein the steps of electromagnetically guiding first and second drops deposit the drops at a density of at least 1200 dots per inch.

26. A jet printer, comprising:

means for electromagnetically guiding each of a plurality of charged drops of printing fluid to a print substrate through an electromagnetic field, means for applying a digital filtering function to a desired input position value and to values of charge on the drops relative to the electromagnetic field, to obtain a deflection value for a further drop of printing fluid, wherein the means for of applying a digital filtering function applies a transfer function that includes a sum of at least one previous input position value multiplied by a first coefficient, and at least one previous deflection value multiplied by a second coefficient, and means for converting the deflection value to an electromagnetic field intensity to guide the further drop to the substrate.

27. A jet printer, comprising:

means for electromagnetically guiding each of a plurality of charged drops of printing fluid to a print substrate through an electromagnetic field, means for applying a digital filtering function to a desired input position value and to values of charge on the drops relative to the electromagnetic field, to obtain a deflection value for a further drop of printing fluid, wherein the means for of applying a digital filtering function applies a transfer function that includes a sum of previous input position values each multiplied by one of a first plurality of coefficients, and previous deflection values each multiplied by one of a second plurality of coefficients, and means for converting the deflection value to an electromagnetic field intensity to guide the further drop to the substrate.

28. A jet printer, comprising:

means for moving a jet printing fluid source relative to a print substrate along a direction of an axis of rotation of a print substrate, means for rotating the print substrate relative to the jet printing fluid source about the axis of rotation such that the combined action of the means for moving and the means for rotating cause the jet printing fluid source to advance in a helical progression with respect to the print substrate during a plurality of drum rotations, means for electromagnetically guiding a first drop of printing fluid from the jet printing fluid source so that it lands on the print substrate at a first distance along the direction of the axis of rotation of the print substrate from the jet printing source, and for electromagnetically guiding a second drop of printing fluid from the jet printing fluid source so that it lands on the print substrate at a second distance along the direction of the axis of rotation of the print substrate from the jet printing source after the print substrate has rotated, wherein the second distance is different from the first distance, and swathing means defining a swathing order for the first and second drops to separate trajectories of the first and second drops.

29. The jet printer of claim 28 wherein the means for electromagnetically guiding are further for guiding the first and second drops at locations that are spaced apart both longitudinally and radially with respect to the axis of rotation.

30. The jet printer of claim 28 further including means for causing the means for guiding to perform a half-tone printing process.

31. The jet printer of claim 28 wherein the means for moving the jet printing fluid source includes means for moving a carriage that supports the jet printing fluid source.

32. The method of claim 28 wherein the means for guiding is for guiding the first and second drops at a density of at least 1200 dots per inch.

* * * * *